US005895046A

United States Patent [19]

Lee

[11] Patent Number: 5,895,046

[45] Date of Patent: Apr. 20, 1999

[54] SECTIONAL CHESSMEN FOR PLAYING CHESS

[76] Inventor: Ki-suk Lee, 309-103 Olympic Apt., Oryun-dong, Songpa-gu, Seoul, Rep. of Korea, 138-151

[21] Appl. No.: 08/941,277

[22] Filed: Sep. 30, 1997

[30] Foreign Application Priority Data

Jun. 16, 1997 [KR] Rep. of Korea ..... 1997-14483 U

[51] Int. Cl.[6] ..... A63F 9/00

[52] U.S. Cl. ..... 273/288

[58] Field of Search ..... 273/288, 289, 273/290, 291, 260, 261

[56] References Cited

U.S. PATENT DOCUMENTS

| | | | |
|---|---|---|---|
| 1,472,657 | 10/1923 | Lillard | 273/290 |
| 2,196,861 | 4/1940 | Gruber | 273/290 X |
| 2,273,932 | 2/1942 | Caesar | 273/290 X |
| 3,947,040 | 3/1976 | Samuels | 273/288 |
| 4,188,035 | 2/1980 | Metzler, Jr. | 273/288 X |
| 4,234,188 | 11/1980 | Keegan | 273/290 |
| 4,570,938 | 2/1986 | Ferris et al. | 273/289 X |
| 5,062,645 | 11/1991 | Goodman et al. | 273/290 X |
| 5,407,204 | 4/1995 | Meyer, III | 273/288 X |

*Primary Examiner*—William E. Stoll
*Attorney, Agent, or Firm*—Hazel & Thomas, P.C.

[57] ABSTRACT

This invention relates to sectional chessmen for playing chess, and more particularly to portable sectional chessmen. Each chessman may be dismantled for ease of carrying and then its sectional pieces rejoined for playing chess. The sectional pieces of the chessmen are integrally formed with a synthetic resin plate of predetermined thickness.

1 Claim, 3 Drawing Sheets

SECTIONAL CHESSMEN FOR PLAYING CHESS

FIELD OF THE INVENTION

This invention relates to sectional chessmen for playing chess, and more particularly to, portable sectional chessmen for playing chess in which each section of a chessman is formed integrally with a synthetic resin plate of a predetermined thickness so that it is possible to minimize size of the chessmen for users' convenient carrying, reducing manufacturing cost thereof. The users may enjoy playing chess regardless of place, and such a chess game is good for developing intelligence of children.

DESCRIPTION OF THE PRIOR ART

In general, conventional chessmen such as king, queen, rook, bishop, knight, and pawn are formed three-dimensionally with wood or plastic materials by carving or injection molding.

The conventional chessmen have, however, a disadvantage that it is not convenient to carry them since they are too bulky due to the three-dimensional figure.

The conventional chessmen have another disadvantage that the three-dimensional figure is complicated to manufacture so that the manufacturing cost increases. Especially, carving the chessmen is very time-consuming. Further, a bulky additional case is necessary to receive them to carry them without damage thereof.

SUMMARY OF THE INVENTION

It is, therefore, an object of the present invention to provide sectional chessmen which is formed integrally with a synthetic resin plate in a predetermined thickness and easy to be jointed or disjointed as desired.

Therefore, the bulk of the chessmen may be considerably reduced and users may enjoy playing chess with the sectional chessmen which may be jointed easily and also carry them conveniently by disjointing them into small sections.

According to the present invention, sectional chessmen includes a plane body section having a protrusion at its bottom edge and a groove, a base section having an side edge portion which connected to a side edge portion of the body section with a plurality of connecting pieces and a through hole in the center thereof to be inserted with the protrusion of the body section, and a head section formed in the shape of plane chessmen and connected with the body section with a protrusion which having a compensatory size and shape with the groove of the body section to be coupled therewith, wherein each section may be jointed and disjointed each other by users as necessary.

Therefore, it becomes possible to reduce the bulk of the chessmen so that users may carry them conveniently anywhere to play chess.

BRIEF DESCRIPTION OF THE DRAWINGS

The present invention will become apparent upon reading the following detailed description of exemplary embodiments and upon reference to the accompanying drawings, in which.

DETAILED DESCRIPTION OF THE INVENTION

Figure 1:
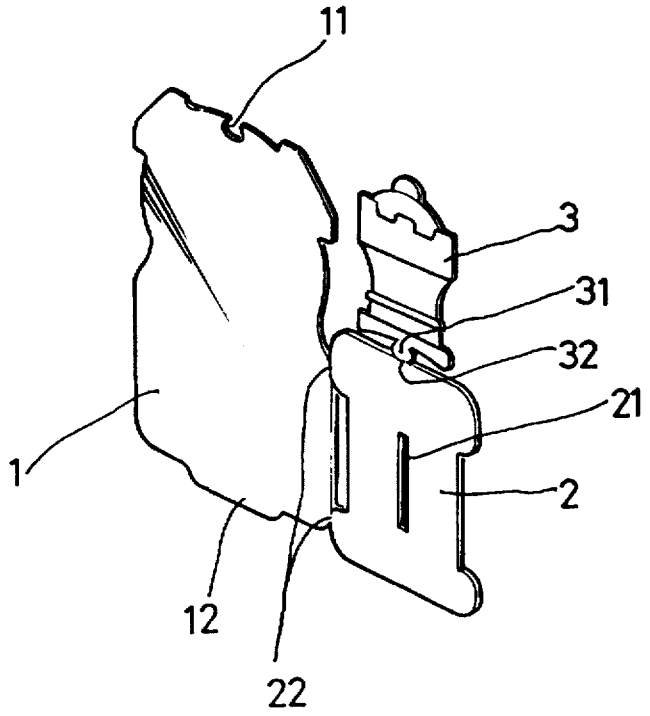
FIG. 1 is a schematical perspective view of a chessman according to the present invention.
Figure 2:
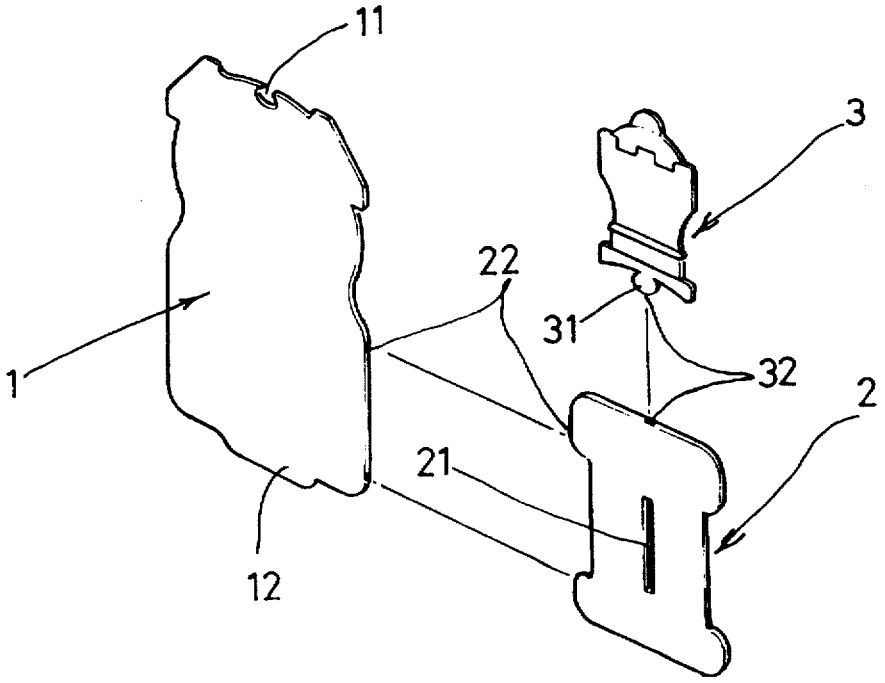
FIG. 2 is a schematical perspective view of the chessman as shown in FIG. 1 in which the chessman is disjointed into each section.
Figure 3A:
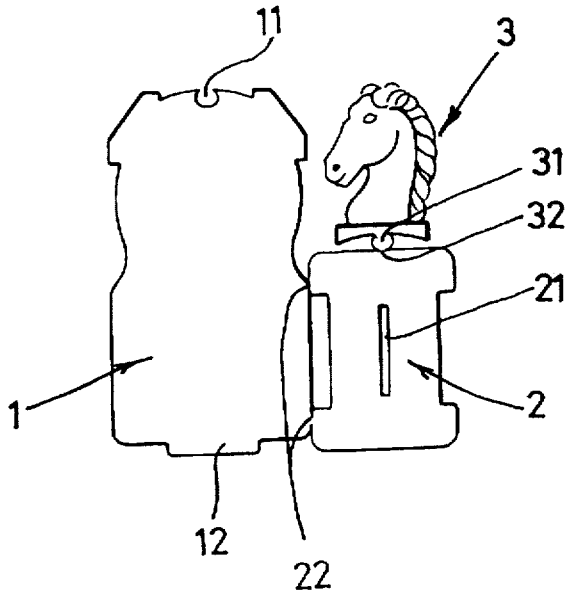
FIGS. 3(*a*) to 3(*d*) are schematical plane views respectively showing shapes of chessmen according to the present invention.
Figure 3B:
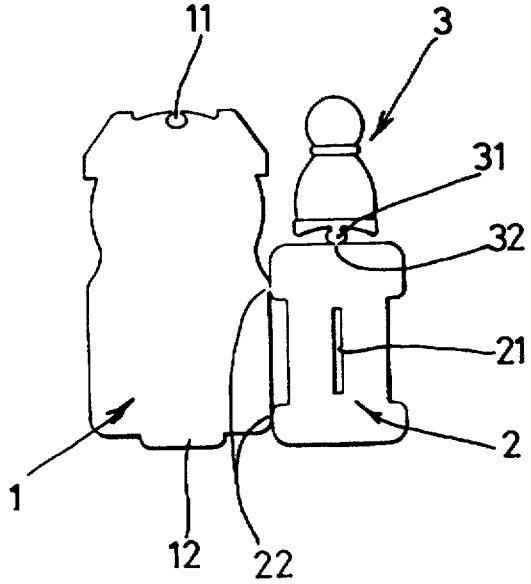
Figure 3C:
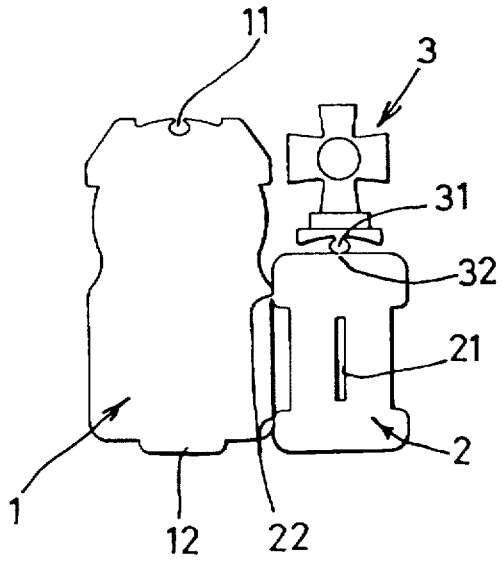
Figure 3D:
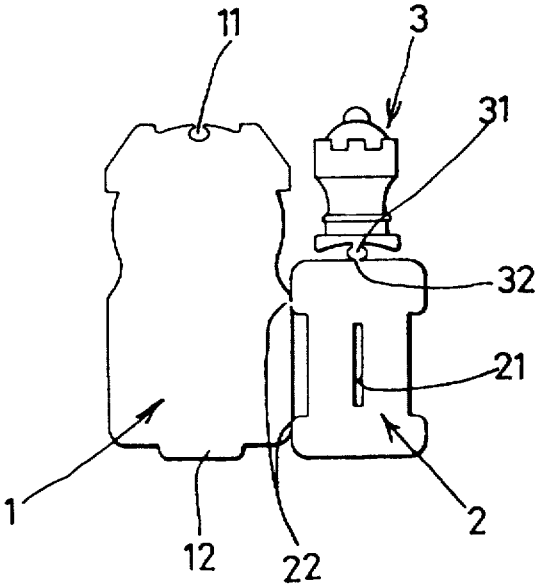

FIG. 1 and FIG. 2 schematically show a chessman according to the present invention. In FIG. 1 and FIG. 2, a body section 1 is formed in the shape of a plane plate having a predetermined width and height. The body section 1 is provided with a groove 11 at its top edge portion and a longitudinal protrusion 12 at its bottom edge portion.

A base plate 2 has a through hole 21 at its center and is connected at its one side edge portion to one side edge portion of the body section 1 with a plurality of relatively short and small connecting pieces 22. The through hole 21 of the base plate 2 is formed in a complementary size and shape with the protrusion 12 of the body section 1. Therefore, if the body section 1 is fitted into the through hole 21 of the base plate 2 with its protrusion 12, the body section 1 is perpendicularly set on the plane base section 2.

A head section 3 is formed in the shapes of each character of chessmen, for example, plane shapes of king, queen, rook, bishop, knight, and pawn, as shown in FIGS. 3(*a*) to 3(*d*). The protrusion 31 of the head section 3 is formed at its bottom edge portion in a complementary size and shape with the groove 11 of the body section 1 and connected to a center portion of the base section 2 with a relatively short and small connecting piece 32. Therefore, if the head section 3 is fitted into the groove 11 of the body section 1 with its protrusion 31, the head section 3 is set integrally and straightly on the plane body section 1 and perpendicularly to the base section 2.

The chessmen as described hereinabove is formed by press molding with synthetic resin and the respective sections of body, base and head are formed integrally, so that the bulk of the chessmen is small enough to carry conveniently and, accordingly, the size of the case to receive the chessmen may be smallized.

The present invention now will be described in more detail in connection with its joint.

When users desire to play chess, the connecting pieces 22 of the base section 2 and the connecting pieces 32 of the head section 3 are cut by pulling and each section of the chessmen is disjointed, as shown in FIG. 2.

Figure 4:
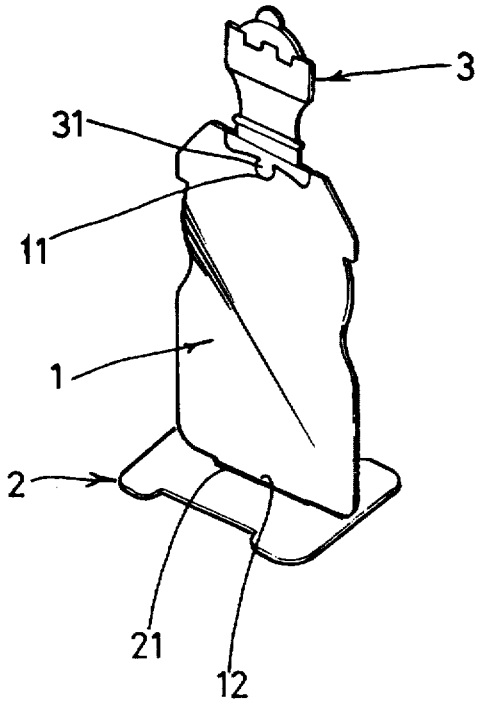
FIG. 4 is a schematical perspectively view of the chessman as shown in FIG. 1, in which each of the sections of the chessman is jointed completely as a chessman.
Figure 5:
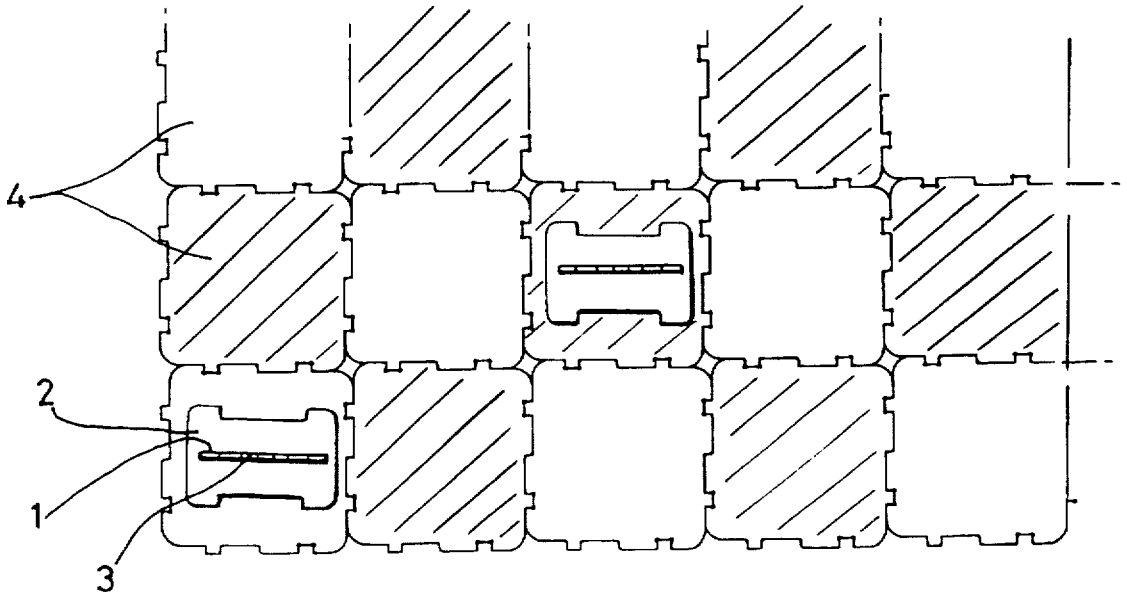
FIG. 5 is a schematical plane view showing the chessman of FIG. 1 which is laid on a chessboard.

Then, the bottom protrusion 12 of the body section 1 is fitted into the linear through hole 21 in the center of the base section 2 and the bottom protrusion 31 of the head section 3 is fitted into the groove 11 at the top of the body section 1. FIG. 4 shows such a completely jointed chessman.

Since the chessmen are formed not in the three-dimensional shapes but in plane shapes, the bulk of the chessmen decreases and users can carry them in a relatively small box anywhere. Also, children may develop their intelligence while jointing the sections into chessmen.

As described hereinabove, the chessmen according to the present invention is formed with a synthetic resin plate of a predetermined thickness into compact several sections to be jointed or disjointed as desired.

Therefore, users may enjoy playing chess with the slim chessmen anywhere since it is easy to joint and disjoint and convenient to carry.

Further, the manufacturing cost may be reduced by omitting the conventional time-consuming procedures.

Those skilled in the art will readily recognize that these and various other modifications and changes may be made to the present invention without strictly following the exemplary application illustrated and described herein and without departing from the true spirit and scope of the present invention, which is set forth in the following claims.

What is claimed is:

1. Sectional chessman comprises:

a plane body section having a protrusion at its bottom edge portion and a groove at its top edge portion;

a base section having a side edge portion which is connected to a side edge portion of said body section with a plurality of connecting pieces, and a through hole in a center thereof to be inserted with said protrusion of said body section; and a head section formed in the shape of a planar chessman and connected to said base section with a connecting piece, having a protrusion at its bottom edge portion of a corresponding size and shape with said groove of said body section.

* * * * *